US010512127B2

(12) United States Patent
Hayashi

(10) Patent No.: US 10,512,127 B2
(45) Date of Patent: Dec. 17, 2019

(54) COOKING APPARATUS

(71) Applicant: Panasonic Intellectual Property Management Co., Ltd., Osaka (JP)

(72) Inventor: Hiroki Hayashi, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/573,018

(22) PCT Filed: Aug. 3, 2016

(86) PCT No.: PCT/JP2016/003571
§ 371 (c)(1),
(2) Date: Nov. 9, 2017

(87) PCT Pub. No.: WO2017/038006
PCT Pub. Date: Mar. 9, 2017

(65) Prior Publication Data

US 2018/0139805 A1 May 17, 2018

(30) Foreign Application Priority Data

Sep. 2, 2015 (JP) ..... 2015-172515

(51) Int. Cl.
*H05B 6/64* (2006.01)
*H05B 6/76* (2006.01)
*H05B 6/68* (2006.01)

(52) U.S. Cl.
CPC ..... *H05B 6/6473* (2013.01); *H05B 6/645* (2013.01)

(58) Field of Classification Search
CPC ..... H05B 6/645; H05B 6/6473; F24C 15/322; F24C 7/087; F24C 7/04
(Continued)

(56) References Cited

U.S. PATENT DOCUMENTS 7,223,944 B2 * 5/2007 Kitabayashi ..... F24C 15/325 219/395
2004/0104224 A1 * 6/2004 Shon ..... H05B 6/6458 219/707

(Continued)

FOREIGN PATENT DOCUMENTS

EP 3346189 A1 7/2018
JP 2000-074376 3/2000
JP 2009-250493 10/2009

OTHER PUBLICATIONS

The Extended European Search Report dated Jul. 25, 2018 for the related European Patent Application No. 16841048.8.

(Continued)

*Primary Examiner* — Quang T Van
(74) *Attorney, Agent, or Firm* — Brinks Gilson & Lione

(57) ABSTRACT

Cooking apparatus (10) includes heating chamber (4), radiant heater unit (38), convection device (30), a temperature sensor, and a control unit. Radiant heater unit (38) is provided inside heating chamber (4) and radiant-heats an object to be heated. Convection device (30) is provided behind heating chamber (4) and convection-heats the object. The temperature sensor is provided inside convection device (30) and detects temperature inside convection device (30). The control unit controls the temperature inside heating chamber (4) by making radiant heater unit (38) and convection device (30) operate in response to the temperature detected by the temperature sensor. This aspect achieves a stable level of finish and a prolonged service life of radiant heater unit (38).

2 Claims, 6 Drawing Sheets

(58) Field of Classification Search
USPC ..... 219/681, 400, 413, 397, 398, 685, 690, 219/691, 702, 715, 739, 740, 741, 742, 219/707; 126/20, 20.2, 190, 191, 200, 126/369
See application file for complete search history.

(56) References Cited

U.S. PATENT DOCUMENTS

| | | | | |
|---|---|---|---|---|
| 2004/0178192 | A1* | 9/2004 | Muegge | F24C 15/325 219/681 |
| 2010/0282097 | A1* | 11/2010 | Schulte | A21B 1/245 99/476 |
| 2013/0308678 | A1 | 11/2013 | Bach et al. | |

OTHER PUBLICATIONS

International Search Report of PCT application No. PCT/JP2016/003571 dated Oct. 25, 2016.

* cited by examiner

COOKING APPARATUS

TECHNICAL FIELD

The present disclosure relates to a cooking apparatus that microwave-heats an object to be heated such as foodstuffs, particularly to a business-use cooking apparatus used in a store such as a convenience store and a fast food store.

BACKGROUND

Some business-use cooking apparatuses execute, in addition to the microwave heating mode in which an object is heated using microwaves generated by a magnetron, one or both of the grill mode and the convection mode (refer to PTL 1 for example).

The grill mode is a mode in which an object is heated by radiant heat from a grill heater. The convection mode is a mode in which an object is heated by convecting hot airflow from a convection device, inside a heating chamber. Hereinafter, heating by radiant heat is referred to as radiant heating; heating by convecting hot airflow, convection heating.

FIG. 7 is a timing diagram illustrating a cooking sequence in the above-described existing cooking apparatus.

A business-use cooking apparatus needs to reliably execute heating processes for various types of cooking at accurate temperature and for accurate time determined in advance. To serve customer's orders quickly, reducing cooking time is also important. For this reason, a business-use cooking apparatus has a grill heater and two magnetrons. Each of the magnetrons is the same as that used for a domestic-use cooking apparatus.

CITATION LIST

Patent Literature

PTL 1: Japanese Patent Unexamined Publication No. 2009-250493

SUMMARY

A business-use cooking apparatus is requested to use these devices efficiently to reduce cooking time, and to heat an object uniformly.

In an attempt to heat an object more quickly and uniformly, variations in the output of the grill heater due to fluctuations in power supply voltage may cause uneven or insufficient browning. Too high surface temperature of the grill heater may shorten its service life.

An existing business-use cooking apparatus controls chamber-inside temperature using on/off control. Accordingly, if the grill heater is off when heating starts, heating is to start at low surface temperature of the grill heater, which causes variations in the level of finish of cooking including the grill mode. In view of the service life of the grill heater, the surface temperature of the heater tube needs to be within a tolerance such that the service life will not be shortened and it is difficult to control to further raise the surface temperature when the grill heater is off.

To solve the above-described existing problems, an object of the present disclosure is to provide a cooking apparatus that achieves a stable level of finish and a prolonged service life of the grill heater.

A cooking apparatus according to one aspect of the present disclosure includes a heating chamber, a radiant heater unit, a convection device, a temperature sensor, and a control unit. An object to be heated is rested in the heating chamber. The radiant heater unit is provided in the heating chamber and radiant-heats the object. The convection device is provided behind the heating chamber and convectively heats the object. The temperature sensor is provided inside the convection device and detects the temperature inside the convection device. The control unit makes the radiant heater unit and the convection device operate in response to the temperature detected by the temperature sensor to control the temperature inside the heating chamber.

This aspect provides a stable level of finish by controlling the temperature inside the heating chamber while keeping the surface temperature of the radiant heater unit at a higher level.

DETAILED DESCRIPTION OF THE PREFERRED EMBODIMENT

A cooking apparatus according to the first aspect of the present disclosure includes a heating chamber, a radiant heater unit, a convection device, a temperature sensor, and a control unit. An object to be heated is rested in the heating chamber. The radiant heater unit is provided in the heating chamber and radiant-heats the object. The convection device is provided behind the heating chamber and convectively heats the object. The temperature sensor is provided inside the convection device and detects the temperature inside the convection device. The control unit makes the radiant heater unit and the convection device operate in response to the temperature detected by the temperature sensor to control the temperature inside the heating chamber.

This aspect provides a stable level of finish by controlling the temperature inside the heating chamber while keeping the surface temperature of the radiant heater unit at a higher level.

A cooking apparatus according to the second aspect of the present disclosure is configured to make the radiant heater unit operate within the rated output in the first aspect.

This aspect achieves a stable level of finish and a prolonged service life of the grill heater by controlling the surface temperature of the radiant heater unit to keep it at a high level so as not to affect the service life of the radiant heater unit.

Hereinafter, a description is made of a cooking apparatus according to an embodiment of the disclosure with reference to the attached drawings.

In this embodiment, cooking apparatus 10 is a business-use microwave oven that executes the microwave heating mode, grill mode, and convection mode, and is used in a store such as a convenience store and a fast food store.

Figure 1:
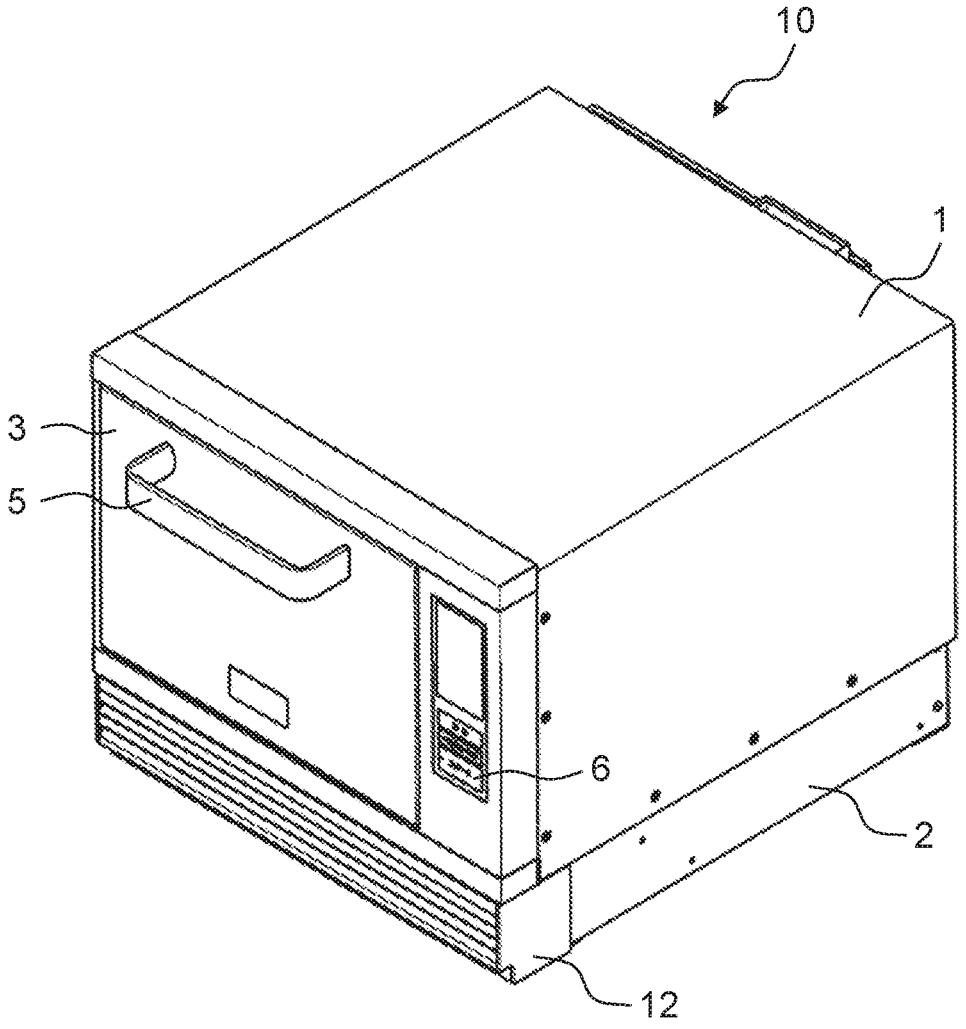
FIG. 1 is an external perspective view of a cooking apparatus according to an exemplary embodiment of the present disclosure.
Figure 2:
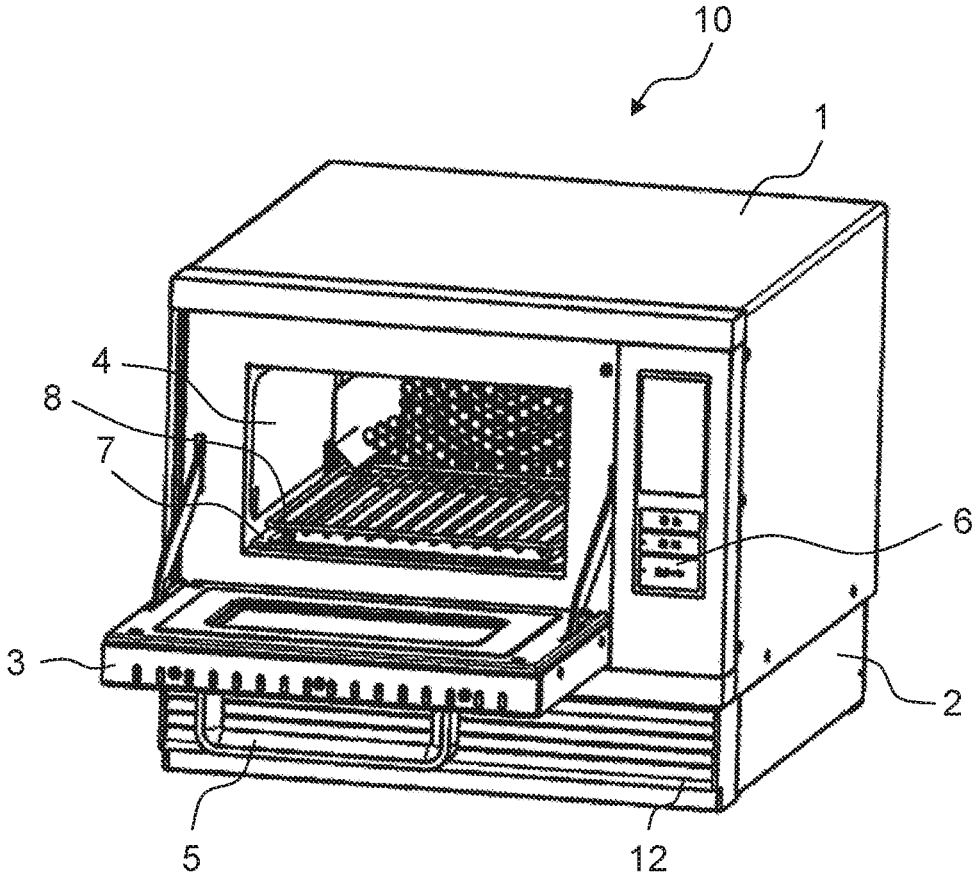
FIG. 2 is a perspective view of the cooking apparatus according to the embodiment, with its door open.
Figure 3:
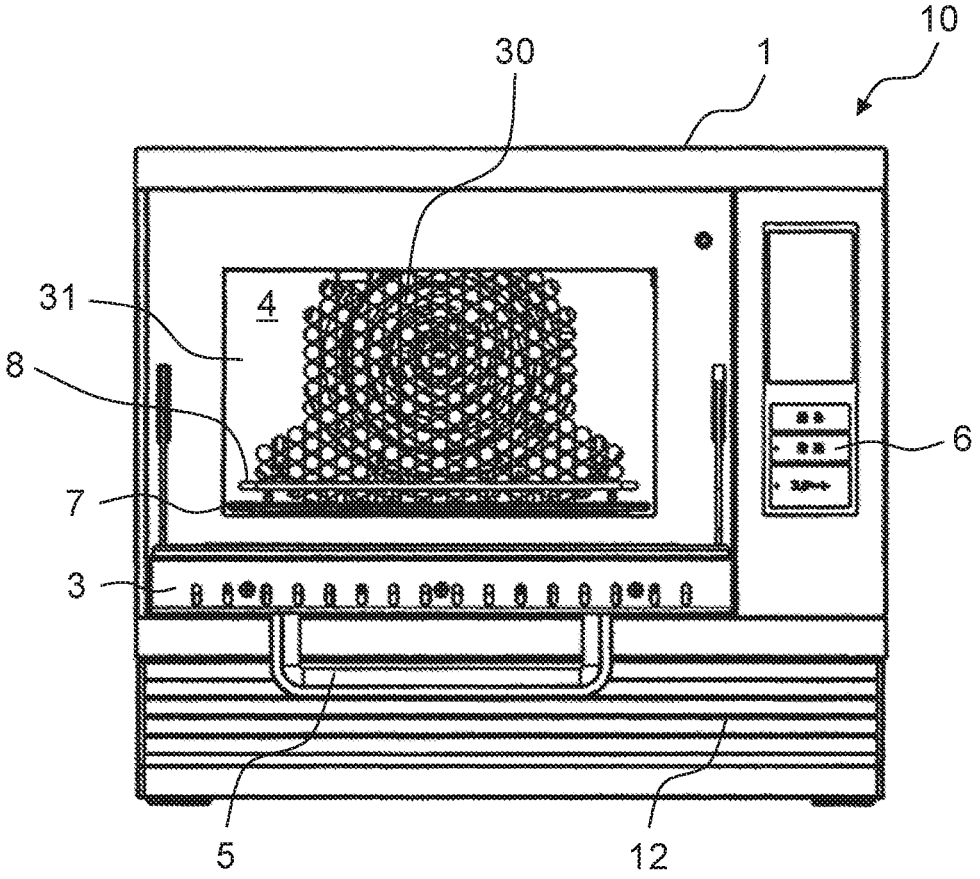
FIG. 3 is a front view of the cooking apparatus according to the embodiment, with its door open.
Figure 4:
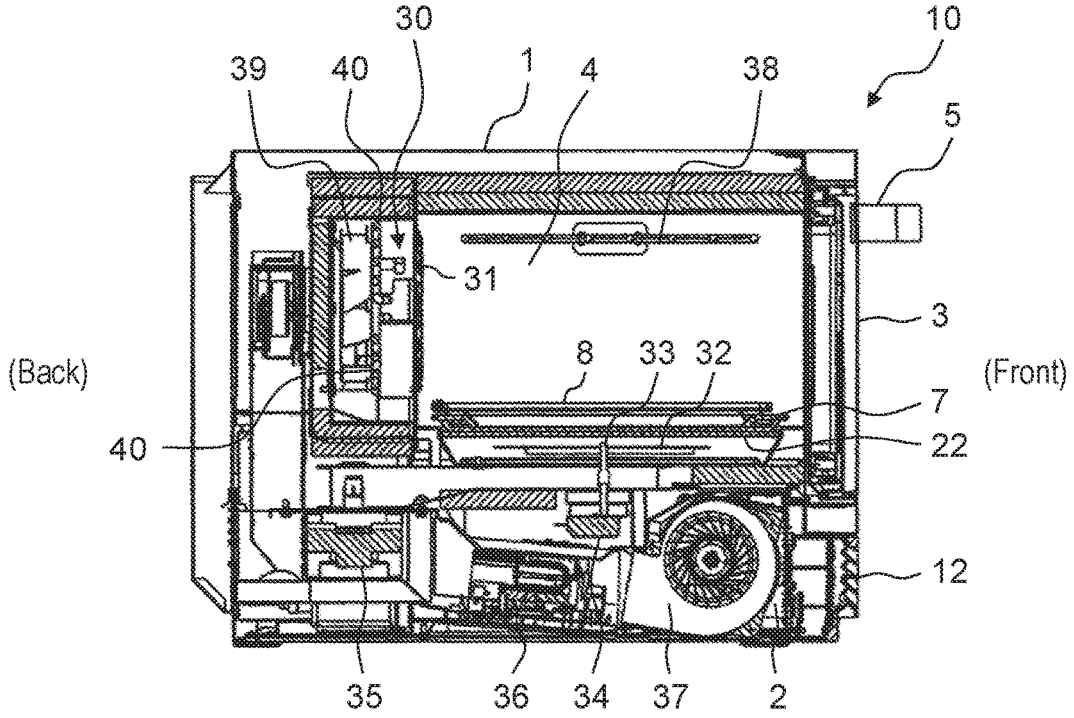
FIG. 4 is a front-back sectional view of the cooking apparatus according to the embodiment.

FIG. 1 is a perspective view of the appearance of cooking apparatus 10 according to this embodiment, with door 3 on its front surface closed. FIGS. 2 and 3 are respectively a perspective view and a front view of cooking apparatus 10, with door 3 open. FIG. 4 is a front-back sectional view of cooking apparatus 10.

As shown in FIGS. 1 and 2, cooking apparatus 10 includes main unit 1 and machine compartment 2. Machine compartment 2 is provided under main unit 1 so as to support main unit 1. Door 3 is provided on the front surface of main unit 1 so as to close heating chamber 4. On the front surface of machine compartment 2, detachable front grill panel 12 is provided.

As shown in FIG. 2, heating chamber 4 is formed inside main unit 1. Heating chamber 4 has a substantially rectangular parallelepiped space with an opening in its front surface in order to rest an object to be heated inside the space.

In this embodiment, the side of heating chamber 4 in which the opening is formed is defined as the front side of cooking apparatus 10; the opposite, as the rear side of cooking apparatus 10. The right side of cooking apparatus 10 viewed from the front is simply defined as the right side; the left side, the left side.

Door 3 is attached with hinges provided under the opening of heating chamber 4. Door 3 is opened and closed vertically using handle 5 provided on door 3. With door 3 closed, heating chamber 4 becomes a closed space for heating an object rested in heating chamber 4 with microwaves for example.

In this embodiment, a control panel is attached on the right front side of main unit 1. The control panel is provided with operation unit 6. Operation unit 6 is provided with operation keys and a display unit for setting conditions of heat-cooking. A control unit (unillustrated) that receives a signal from operation unit 6 and controls the display unit is provided behind the control panel.

As shown in FIG. 2, tray 7 made of ceramics and wire rack 8 made of stainless steel are disposed inside heating chamber 4 in a containable manner. Concretely, tray 7 is made of cordierite (ceramics with a composition of $2MgO.2Al_2O_3.5SiO_2$).

Wire rack 8 is a rest unit made of a net-shaped material on which an object to be heated is rested. Wire rack 8 allows hot airflow to be efficiently circulated even to the undersurface of the object. Tray 7 is placed under wire rack 8 so as to receive fat for example dropping from the object.

As shown in FIG. 4, machine compartment 2 placed under heating chamber 4 is provided therein with magnetron 35, inverter 36, and cooling fan 37. Magnetron 35 is a microwave generating unit that generates microwaves. Inverter 36 is controlled by the control unit to drive magnetron 35. Cooling fan 37 is controlled by the control unit to cool the inside of machine compartment 2.

Microwaves generated by magnetron 35 travel through the waveguide and are radiated into heating chamber 4 through the microwave emission hole formed in the waveguide and an opening formed in the bottom surface of heating chamber 4. Stirrer 32 is controlled by the control unit to stir microwaves radiated into heating chamber 4. Cooking apparatus 10 thus microwave-heats an object contained in heating chamber 4.

Cooking apparatus 10 includes grill heater 38, which is a radiant heater unit provided near the ceiling of heating chamber 4. In this embodiment, grill heater 38 is a sheath heater. The control unit makes grill heater 38 operate to control the grill mode. In the grill mode, an object rested in heating chamber 4 is radiant-heated by radiant heat of grill heater 38.

As shown in FIGS. 3 and 4, cooking apparatus 10 includes convection device 30 that is provided behind back surface wall 31 of heating chamber 4 and sends hot airflow into heating chamber 4 to convectively heat an object. Convection device 30 draws air inside heating chamber 4 from the central part of back surface wall 31, heats the air to produce hot airflow, and blows it out from the bottom of back surface wall 31 into heating chamber 4. The hot airflow sent into heating chamber 4 becomes a circulating flow in there.

Inside convection device 30, a thermistor (unillustrated) is provided that is a temperature sensor detecting the temperature of the space inside convection device 30. This thermistor detects a signal corresponding to the temperature of the space inside convection device 30. The control unit makes convection device 30 operate in response to this signal.

Cooking apparatus 10 performs microwave heating, radiant heating, and heating by circulating hot airflow separately, or performs at least two of the three types of heating simultaneously.

In this embodiment, two magnetrons 35 are used (unillustrated), with a total output power of 1,200 W to 1,300 W. Microwaves output from two magnetrons 35 respectively travel through two waveguides, pass through openings formed in the waveguides and in the bottom surface of heating chamber 4, are stirred by stirrer 32, and are radiated into heating chamber 4.

To drive two magnetrons 35, two inverters 36 are provided inside machine compartment 2. Inside machine compartment 2, cooling fans 37 are placed in order to cool magnetron 35 and inverter 36. In this embodiment, for two cooling fans 37 to cool one set of magnetron 35 and inverter 36, a total of four cooling fans 37 are provided.

Cooling fan 37 draws outside air from front grill panel 12 provided on the front surface of machine compartment 2 and sends the air to the rear to cool inverter 36, magnetron 35, and other components. In machine compartment 2, a power circuit board is disposed and a cooling fan for cooling the power circuit board is further provided.

In this embodiment, four cooling fans 37 for inverter 36 and magnetron 35, and a cooling fan for the power circuit board are multiblade fans. A total of five rotation shafts of the cooling fans are disposed linearly.

The air that has travelled to the rear inside machine compartment 2 passes through the exhaust duct disposed on the back surface of main unit 1, moves through between the ceiling of heating chamber 4 and the top surface wall of main unit 1, and is discharged from the front side of main unit 1. This way prevents main unit 1 from becoming too hot.

Hereinafter, a more detailed description is made of the internal structure of cooking apparatus 10 using FIG. 4.

As shown in FIG. 4, tray cradle 22 is made of a ceramic plate material that is microwave-transmissive and is placed on the bottom surface of heating chamber 4. Tray 7 is rested on tray cradle 22.

Stirrer 32 is provided between tray cradle 22 and the bottom surface of heating chamber 4. Stirrer 32 is a wafter that rotates around stirrer shaft 33 in order to stir microwaves. Motor 34 is provided inside machine compartment 2 and rotarily drives stirrer 32.

Back surface wall 31 of heating chamber 4 has a large number of openings formed by punching. Behind back surface wall 31, convection device 30 is provided that takes in air inside heating chamber 4, heats the air, and sends out the hot airflow into heating chamber 4. The space where convection device 30 is placed is separated from heating chamber 4 by back surface wall 31 and communicates with heating chamber 4 through the opening formed in back surface wall 31.

As shown in FIG. 4, convection device 30 has hot airflow generation mechanism 39 for generating hot airflow. Hot airflow generation mechanism 39 takes in air inside heating chamber 4, heats the air to generate hot airflow, and sends it out into heating chamber 4. This produces circulating hot airflow inside heating chamber 4.

Figure 5:
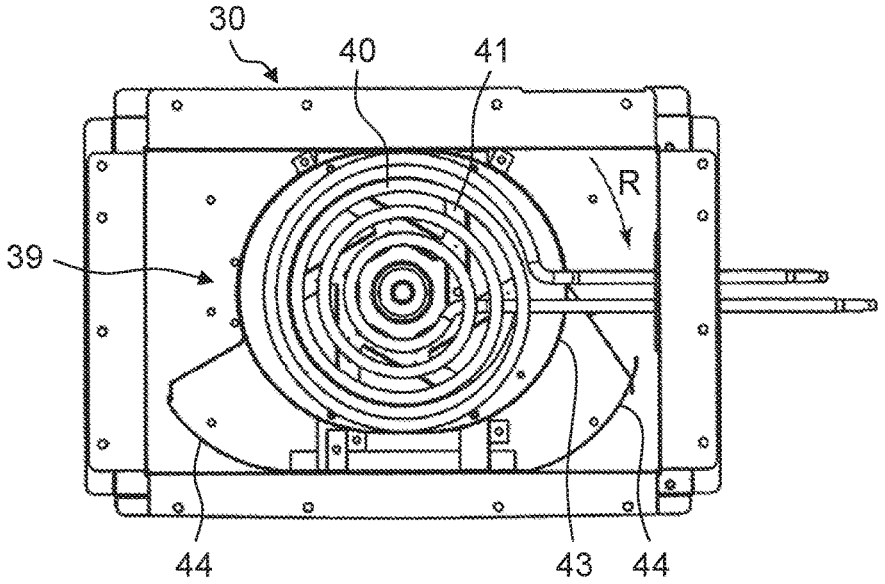
FIG. 5 is a front view of a convection device provided in the cooking apparatus according to the embodiment.

FIG. 5 is a front view of convection device 30. As shown in FIG. 5, hot airflow generation mechanism 39 includes convection heater 40, circulation fan 41, a fan drive unit (unillustrated) that rotarily drives circulation fan 41, and first and second hot airflow guides 43 and 44 that guide hot airflow in hot airflow generation mechanism 39.

Convection heater 40, which is a sheath heater, heats air inside convection device 30. To increase the contact area with air, convection heater 40 is spirally formed at the center (corresponding to the central part of the heating chamber) of convection device 30.

Circulation fan 41 is a centrifugal fan that takes in air at its central part and sends out the air in the centrifugal direction. Circulation fan 41 is disposed behind convection heater 40 and is driven by the fan drive unit provided behind circulation fan 41. In this embodiment, circulation fan 41 rotates in the direction of arrow R (refer to FIG. 5). The control unit controls convection heater 40 and the fan drive unit.

Figure 6:
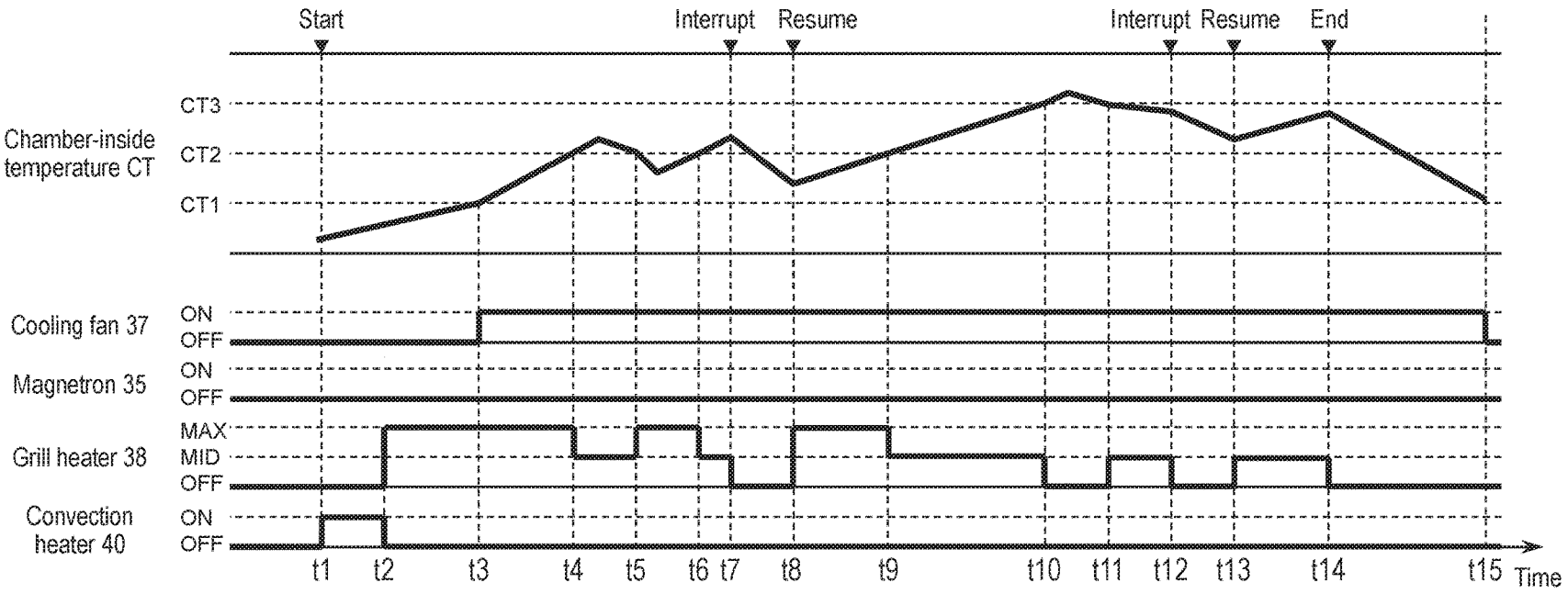
FIG. 6 is a timing diagram illustrating changes of the temperature inside the heating chamber to the cooking sequence of the cooking apparatus according to the embodiment.
Figure 7:
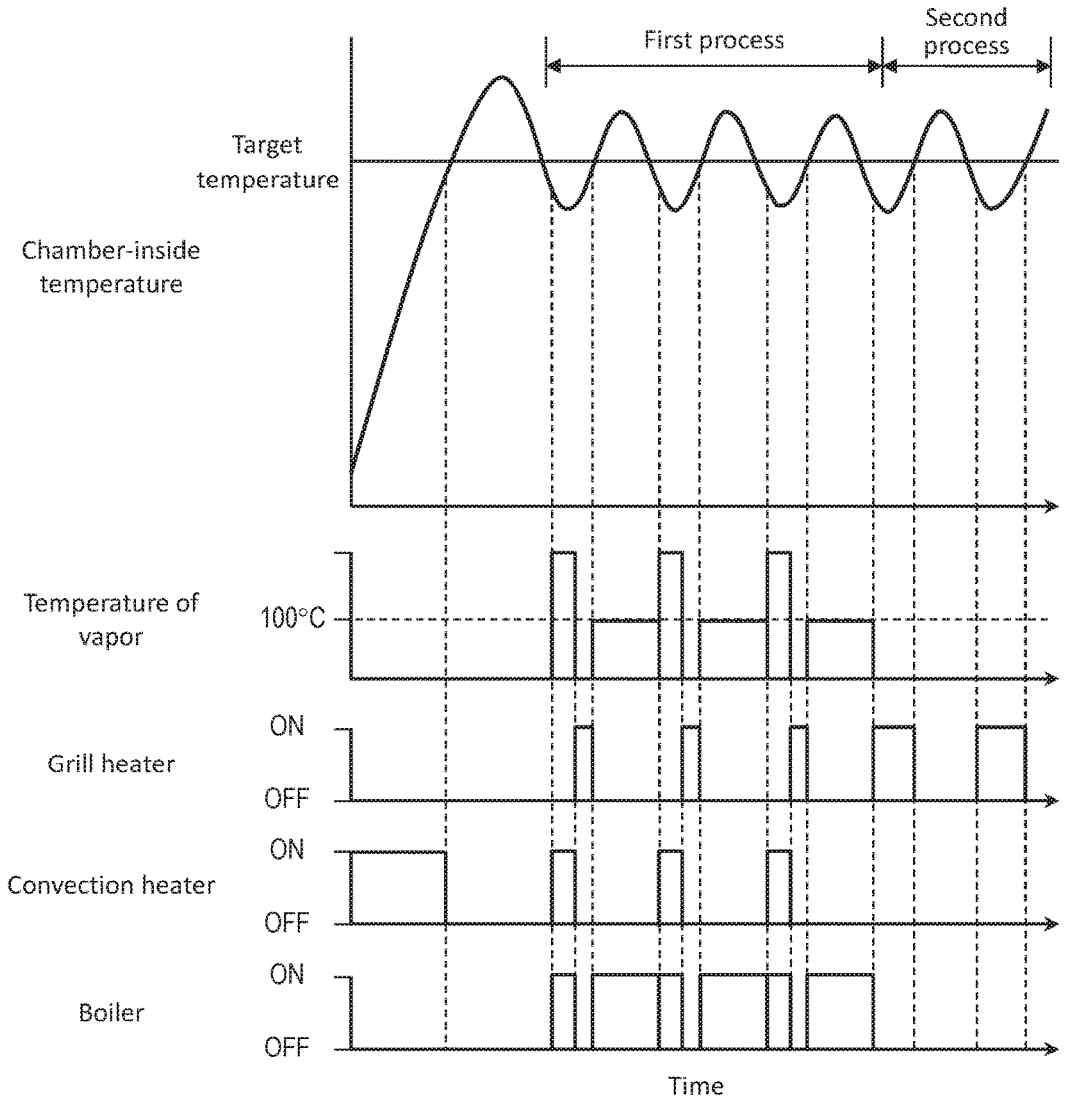
FIG. 7 is a timing diagram illustrating the cooking sequence of an existing cooking apparatus.

FIG. 6 is a timing diagram illustrating changes of chamber-inside temperature CT inside heating chamber 4 to the cooking sequence according to the embodiment.

The inventor has found that there is a correlation between the temperature of the space inside convection device 30 and the temperature inside heating chamber 4 in the grill mode, convection mode, and the heating mode where both of grill heater 38 and convection heater 40 are used.

Accordingly in this embodiment, chamber-inside temperature CT of heating chamber 4 in the grill mode is estimated by measuring the temperature of the space inside convection device 30 using a thermistor provided inside convection device 30.

As shown in FIG. 6, microwaves are not used in this cooking sequence, but the two types of heaters (grill heater 38 and convection heater 40) are used. Thus in this cooking sequence, magnetron 35 continues to be turned off.

First, at time point t1, convection heater 40 is turned on in order to fetch the reference voltage of grill heater 38. At time point t2, convection heater 40 is turned off and fetching the reference voltage of grill heater 38 ends. Simultaneously with this operation, grill heater 38 is turned on at the maximum value (MAX shown in FIG. 6) of the rated output to start cooking by the grill heater. When chamber-inside temperature CT of heating chamber 4 reaches temperature CT1 at time point t3, cooling fan 37 is turned on.

When chamber-inside temperature CT reaches temperature CT2 at time point t4, the output of grill heater 38 is lowered to the intermediate value (MID shown in FIG. 6). This slows the rise of chamber-inside temperature CT, once exceeds temperature CT2, and lowers again to temperature CT2 at time point t5. At this moment, the output of grill heater 38 is set again to the maximum value of the rated output.

When chamber-inside temperature CT reaches temperature CT2 again at time point t6, the output of grill heater 38 is lowered to the intermediate value (MID shown in FIG. 6).

This cooking sequence includes a process during which cooking is interrupted due to open/close of door 3; grill heater 38 is once turned off at time point t7. Cooking resumes at time point t8 and grill heater 38 is turned on at the maximum value of the rated output in order to raise chamber-inside temperature CT lower than temperature CT2. In the meantime, cooling fan 37 continues to operate.

Chamber-inside temperature CT exceeds temperature CT2 at time point t9, and thus the output of grill heater 38 is lowered to the intermediate value. Nevertheless, chamber-inside temperature CT continues to rise. Chamber-inside temperature CT reaches temperature CT3 at time point t10, and thus the output of grill heater 38 is turned off.

This slows the rise of chamber-inside temperature CT, once exceeds temperature CT3, and lowers again to temperature CT3 at time point t11. At this moment, the output of grill heater 38 is set again to the intermediate value. Subsequently, chamber-inside temperature CT gradually lowers.

At time point t12, cooking is interrupted due to open/close of door 3, and grill heater 38 is once turned off. Although cooking resumes at time point t13, chamber-inside temperature CT is still higher than temperature CT2, and thus grill heater 38 is turned on at the intermediate output. In the meantime, cooling fan 37 continues to operate.

At time point t14, grill heater 38 is turned off to complete cooking. Cooling fan 37 continues to operate until time point t15 when chamber-inside temperature CT sufficiently lowers.

In other words, in this embodiment, when chamber-inside temperature CT rises to a predetermined temperature (e.g., temperature CT3 in FIG. 6), the control unit sets the output of grill heater 38 to the intermediate value. Subsequently, when chamber-inside temperature CT lowers to a predetermined temperature (e.g., temperature CT2 in FIG. 6), the output of grill heater 38 is set to the maximum value of the rated output.

According to this embodiment, grill heater 38 is operated at the intermediate output to shorten time during which grill heater 38 is off. This reduces fluctuations in the surface temperature of grill heater 38. Resultingly, even for short-time cooking (e.g., within one minute), uniform, sufficient heating provides a stable level of finish.

In this embodiment, chamber-inside temperature CT is controlled so as not to largely exceed temperature CT3. Specifically, according to this embodiment, grill heater 38 alone with a maximum output of 2,000 W is operated below the rated output of 1,800 W, and thus using grill heater 38 while keeping its surface temperature at a high level does not affect the service life of grill heater 38.

As described above, this embodiment achieves a stable level of finish and a prolonged service life of a grill heater.

INDUSTRIAL APPLICABILITY

The present disclosure is applicable for example to a microwave oven with conventional oven function.

REFERENCE MARKS IN THE DRAWINGS

1 main unit
2 machine compartment

3 door
4 heating chamber
5 handle
6 operation unit
7 tray
8 wire rack
10 cooking apparatus
12 front grill panel
22 tray cradle
30 convection device
31 back surface wall
32 stirrer
33 stirrer shaft
34 motor
35 magnetron
36 inverter
37 cooling fan
38 grill heater
39 hot airflow generation mechanism
40 convection heater
41 circulation fan
43 hot airflow guide

The invention claimed is:

1. A cooking apparatus comprising:

a heating chamber in which an object is rested;

a radiant heater unit provided inside the heating chamber and radiant-heating the object;

a convection device provided behind the heating chamber and convection-heating the object;

a temperature sensor provided inside the convection device and detecting temperature inside the convection device; and a control panel that executes operations from signals received from input keys on the control panel, perform controlling temperature inside the heating chamber by making the radiant heater unit and the convection device operate in response to the temperature detected by the temperature sensor, wherein when the temperature inside the heating chamber rises to a first predetermined temperature, the control panel sets an output of the radiant heater unit to an intermediate value, and when the temperature inside the heating chamber lowers to the first predetermined temperature after the temperature inside the heating chamber exceeds the first predetermined temperature, the control panel sets the output of the radiant heater unit to a maximum value of rated output.

2. The cooking apparatus of claim 1, further comprising:

a machine compartment provided under the heating chamber; and a cooling fan which is controlled by the control panel to cool the inside of the machine compartment, wherein the control panel is configured to make the cooling fan operate when the temperature inside the heating chamber reaches a second predetermined temperature which is lower than the first predetermined temperature, after starting cooking.

* * * * *